US010006322B2

(12) United States Patent
Jeong et al.

(10) Patent No.: US 10,006,322 B2
(45) Date of Patent: Jun. 26, 2018

(54) VARIABLE VALVE LIFT APPARATUS

(71) Applicant: HYUNDAI MOTOR COMPANY, Seoul (KR)

(72) Inventors: Jaehun Jeong, Suwon-si (KR); Hyoung Hyoun Kim, Suwon-si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 35 days.

(21) Appl. No.: 15/258,369

(22) Filed: Sep. 7, 2016

(65) Prior Publication Data

US 2017/0306812 A1 Oct. 26, 2017

(30) Foreign Application Priority Data

Apr. 26, 2016 (KR) ..... 10-2016-0050749

(51) Int. Cl.

| | |
|---|---|
| ***F01L 1/34*** | (2006.01) |
| ***F01L 13/00*** | (2006.01) |
| *F01L 1/18* | (2006.01) |
| *F01L 1/46* | (2006.01) |
| *F01L 1/24* | (2006.01) |

(52) U.S. Cl.

CPC ..... *F01L 13/0036* (2013.01); *F01L 1/185* (2013.01); *F01L 1/2405* (2013.01); *F01L 2001/186* (2013.01); *F01L 2001/467* (2013.01); *F01L 2105/00* (2013.01); *F01L 2810/02* (2013.01)

(58) Field of Classification Search

CPC ..... F01L 13/0021; F01L 1/181; F01L 1/2416; F01L 1/462; F01L 2001/186; F01L 2001/467

See application file for complete search history.

(56) References Cited

U.S. PATENT DOCUMENTS

| | | | |
|---|---|---|---|
| 6,923,151 | B2 | 8/2005 | Kreuter |
| 7,305,951 | B2 | 12/2007 | Fernandez et al. |
| 7,328,675 | B2 | 2/2008 | Seitz et al. |

(Continued)

FOREIGN PATENT DOCUMENTS

| | | | |
|---|---|---|---|
| JP | 2003-254024 | A | 9/2003 |
| KR | 10-0600139 | B1 | 7/2006 |

(Continued)

*Primary Examiner* — Zelalem Eshete

(74) *Attorney, Agent, or Firm* — McDermott Will & Emery LLP

(57) ABSTRACT

A variable valve lift apparatus includes an outer body for selectively performing a first lever motion depending on a rotation of a high cam, the outer body further forming an inside space, an inner body disposed in the inside space of the outer body so as to selectively perform a second lever motion depending on a rotation of the high cam by being selectively locked to the outer body, the selective performing of the second lever motion depending on a rotation of a low cam being released from the outer body, and the inner body being configured so that a valve is connected with one end of the inner body, a connecting shaft rotatably connecting the outer body with the inner body, and a lost motion spring wound around the connecting shaft so as to return the outer body after being relatively rotated with respect to the inner body when the outer body is released from the inner body, wherein a roller rolling-contacting with the low cam is disposed at the inner body, and the connecting shaft is disposed between a pivot axis for a lever motion of the inner body and the roller.

9 Claims, 4 Drawing Sheets

(56) References Cited

U.S. PATENT DOCUMENTS

| | | | |
|---|---|---|---|
| 7,484,487 | B2 | 2/2009 | Zurface et al. |
| 8,464,677 | B2 | 6/2013 | Choi et al. |
| 2006/0157011 | A1 | 7/2006 | Proschko et al. |

FOREIGN PATENT DOCUMENTS

| | | | |
|---|---|---|---|
| KR | 10-2007-0050368 | A | 5/2007 |
| KR | 10-2008-0070011 | A | 7/2008 |

VARIABLE VALVE LIFT APPARATUS

CROSS-REFERENCE TO RELATED APPLICATION

This application claims the benefit of priority to Korean Patent Application No. 10-2016-0050749, filed with the Korean Intellectual Property Office on Apr. 26, 2016, the entire contents of which are incorporated herein by reference.

TECHNICAL FIELD

The present disclosure relates to a variable valve lift apparatus. More particularly, the present disclosure relates to a variable valve lift apparatus which can change a valve lift in that a valve is driven by selectively connecting with a high cam or a low cam.

BACKGROUND

Generally, an internal combustion engine generates power by burning fuel and air received in a combustion chamber. Herein, an intake valve may be operated by a drive of a camshaft, and air flows into the combustion chamber while the intake valve is open. In addition, an exhaust valve may be operated by a drive of a camshaft, and air may be exhausted from the combustion chamber while the exhaust valve is open.

Meanwhile, optimal operations of the intake valve or the exhaust valve may be determined according to rotation speed of the engine. That is, lift and open/close timing of the valves may be properly controlled according to a rotation speed of the engine. A variable valve lift (VVL) apparatus has been developed in which the valves are operated with various lifts according to a rotation speed of the engine for realizing optimal operations of the valves according to a, or a changing, rotation speed of the engine. For example, there is a variable valve lift apparatus in which a plurality of cams for operating the valves at each different lift are provided to the camshaft, and the cam operating the valves is selected according to conditions.

When the plurality of cams is provided to the camshaft, however, the composition for selectively changing the cam to operate the intake valve or the exhaust valve may become complex, and an interference between the elements of the composition may occur. If the plurality of cams is respectively and independently operated for preventing interference between the elements of the composition, an additional constituent element is required for each cam for operating the cam such that costs may be increased.

The above information disclosed in this Background section is only for enhancement of understanding of the background of the disclosure and therefore it may contain information that does not form the prior art that is already known in this country to a person of ordinary skill in the art.

SUMMARY

The present disclosure has been made in an effort to provide a variable valve lift apparatus having advantages of providing a simple composition to prevent interference between constituent elements, and simultaneously, improving dynamic characteristic.

A variable valve lift apparatus may include an outer body for selectively performing a first lever motion depending on a rotation of a high cam, the outer body further forming an inside space; an inner body disposed in the inside space of the outer body so as to selectively perform a second lever motion depending on a rotation of the high cam by being selectively locked to the outer body, the selective performing of the second lever motion depending on a rotation of a low cam being released from the outer body, and the inner body being configured so that a valve is connected with one end of the inner body; a connecting shaft rotatably connecting the outer body with the inner body; and a lost motion spring wound around the connecting shaft so as to return the outer body after being relatively rotated with respect to the inner body when the outer body is released from the inner body, wherein a roller rolling-contacting with the low cam is disposed at the inner body, and the connecting shaft is disposed between a pivot axis for a lever motion of the inner body and the roller.

A pad portion may be in rolling-contact with the high cam at an outside in an axial direction of the roller, is formed at the outer body.

The pad portions may be disposed at both sides of the roller in an axial direction of the roller, and the high cams are disposed at both sides of the low cam in an axial direction of the low cam.

A hydraulic pressure supply member, which supplies hydraulic pressure such that the inner body and the outer body are selectively locked, may be mounted at another end of the inner body, and the pivot axis for a lever motion of the inner body is at a position at which the hydraulic pressure supply member is mounted.

A latching pin may be operated by hydraulic pressure so as to be selectively protruded from the inner body; a latching pin groove formed at the outer body so that the latching pin may be disposed thereon; a latching pin stopper may prevent the latching pin from escaping from the inner body when the latching pin is protruded from the inner body so as to be disposed on the latching pin groove by receiving hydraulic pressure; and a latching spring may return the latching pin when hydraulic pressure is supplied to the latching pin, the inner body may be locked to the outer body when the latching pin is disposed on the latching pin groove.

The latching pin groove, the latching pin, the latching pin stopper and the latching spring may be disposed at the other end side, with respect to the connecting shaft, in the outer body and the inner body.

A hydraulic pressure chamber which forms hydraulic pressure in one end of the latching pin and a drain hole which discharges oil forming hydraulic pressure in the hydraulic pressure chamber to exterior may be formed at the inner body.

The drain hole may be opened such that discharged oil is supplied as a lubricant of the lost motion spring, the connecting shaft and the roller.

An inner stopper may be formed at the inner body and an outer stopper, which is blocked by the inner stopper, is formed at the outer body such that rotation of the outer body is limited to the original position of the outer body when the outer body relatively rotated with respect to the inner body is returned.

The outer stopper and the inner stopper may be disposed at a lower end portion of the connecting shaft.

The outer stopper may be contacted with and supported by the inner stopper in the state of locking the inner body with the outer body.

DETAILED DESCRIPTION

An exemplary embodiment of the present disclosure will hereinafter be described in detail with reference to the accompanying drawings.

Figure 1:
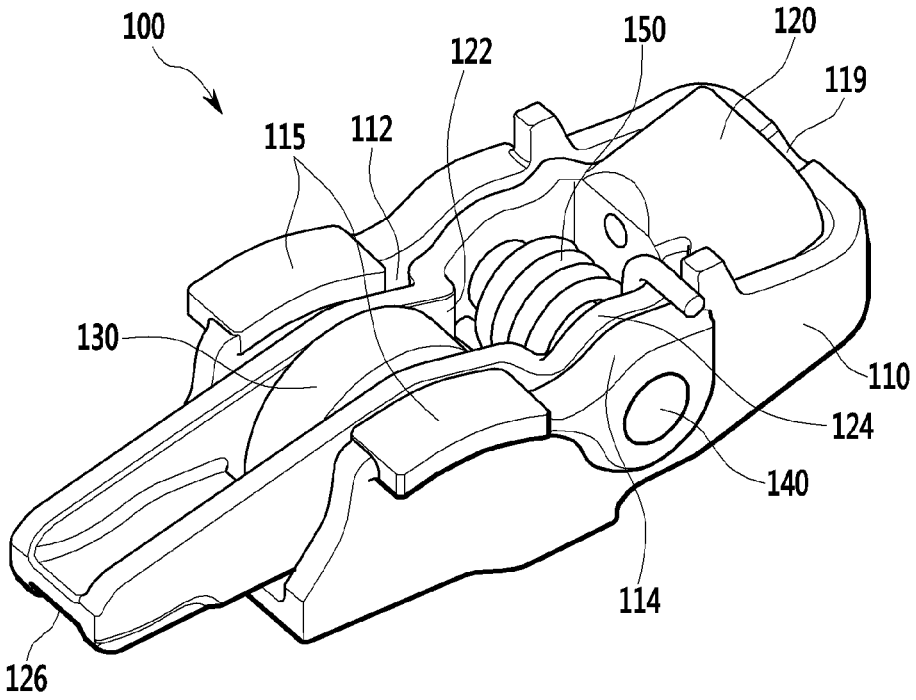
FIG. 1 is a perspective diagram of a variable valve lift apparatus according to an exemplary embodiment of the present disclosure.
Figure 2:
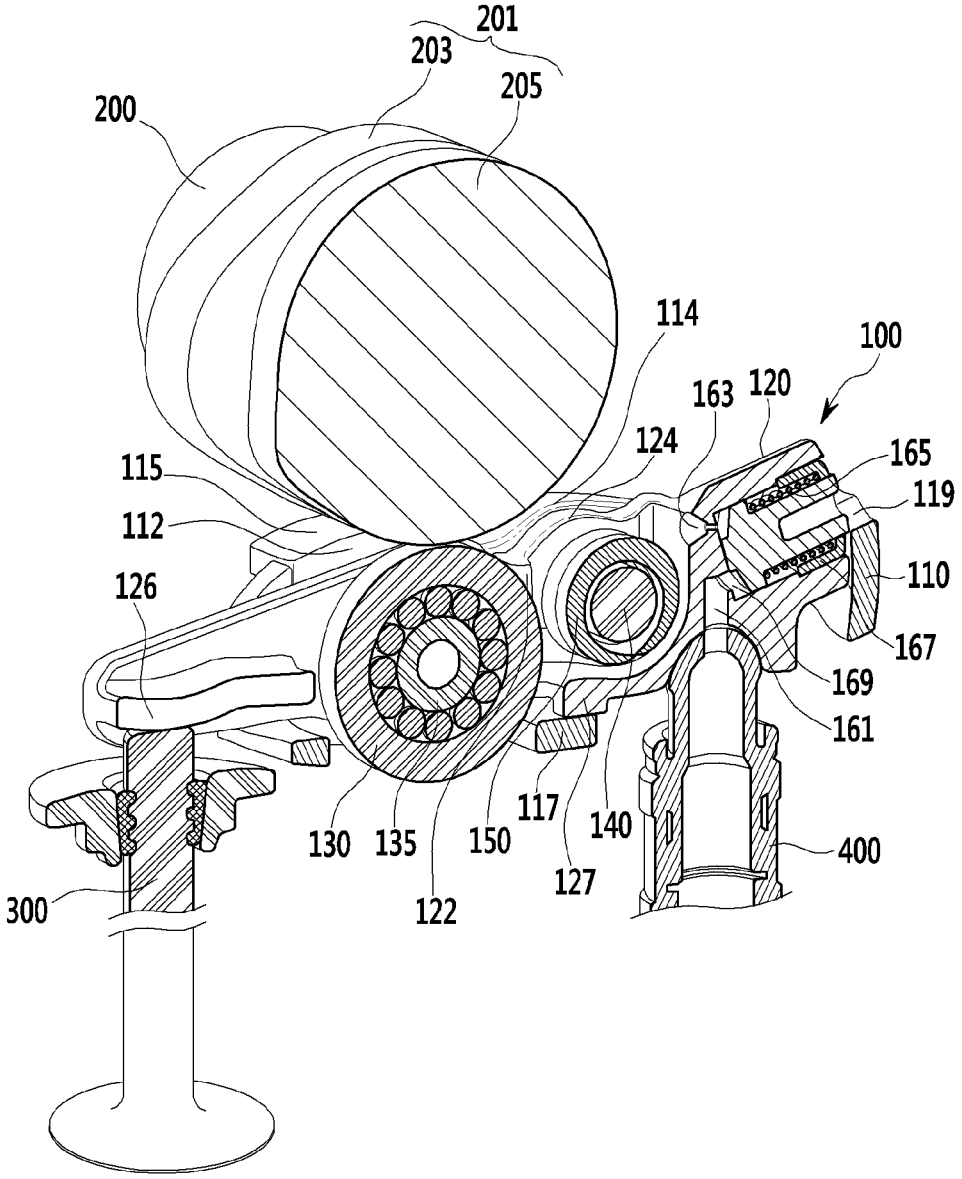
FIG. 2 is a cross-sectional view of a variable valve lift apparatus according to an exemplary embodiment of the present disclosure.

FIG. 1 is a perspective diagram of a variable valve lift apparatus according to an exemplary embodiment of the present disclosure, and FIG. 2 is a cross-sectional view of a variable valve lift apparatus according to an exemplary embodiment of the present disclosure.

As shown in FIG. 1 and FIG. 2, a variable valve lift apparatus 100 according to an exemplary embodiment of the present disclosure may include an outer body 110, an inner body 120, a roller 130, a connecting shaft 140 and a lost motion spring 150. In addition, the variable valve lift apparatus 100 may be operated to selectively realize high lift or low lift of a valve as a device for opening/closing a valve.

The outer body 110 may make a lever motion by receiving torque of a camshaft 200, and may be operated to selectively open/close a valve 300. In addition, a high cam 203 may be formed or disposed at the camshaft 200 so as to transform a rotational motion of the camshaft 200 to a lever motion of the outer body 110. Herein, the valve 300 may be an intake valve or an exhaust valve of an engine. Further, a space 112, formed within the outer body 110 in a vertical direction, may be formed inside of the outer body 110. That is, the outer body 110 may have a set length so as to make a lever motion, and may have a set width and a set thickness so as to form the inside space 112 of the outer body 110.

The inner body 120 may be disposed in the inside space 112 of the outer body 110. In addition, the inner body 120 may be rotatably connected with the outer body 110. Further, the inner body 120 may make a lever motion according to received torque of the camshaft 200, and operate to open/close the valve 300. Herein, a low cam 205 may be formed or disposed at the camshaft 200 so as to transform a rotational motion of the camshaft 200 to a lever, or longitudinal, motion of the inner body 120. Meanwhile, the high cam 203 and the low cam 205 may be formed as an integral cam 201. Furthermore, a space 122, which penetrates the inner body 120 in a vertical direction, may be formed inside of the inner body 120. That is, the inner body 120 may have a set length so as to make a lever motion, and may have a set width and a set thickness so as to form the inside space 122 of the inner body 120.

The valve 300 may be connected with one end of the inner body 120 and a pivot axis of the lever motion may be disposed at the other end. Herein, the pivot axis for the lever motion of the inner body 120 may be disposed a position that a hydraulic pressure supply member 400 to supply hydraulic pressure such as a hydraulic lash adjuster (HLA) is mounted.

In descriptions hereinafter, one end and the other end of each element which are connected to or disposed at the outer body 110 or the inner body 120 may mean a portion on the same side with the one end and the other end of the inner body 120.

The roller 130 may be disposed in the inside space of the inner body 120. In addition, the roller 130 may be rotatably connected with the inner body 120. Meanwhile, a roller rotation shaft 135 may be provided to rotatably connect the roller 130 and the inner body 120. That is, the roller 130 may rotate around the roller rotation shaft 135. Further, the roller 130 may be rolling-contacted, or rollably contacting, with the low cam 205 so as to transform a rotational motion of the camshaft 200 into a lever, or longitudinal, motion of the inner body 120.

The connecting shaft 140 may be provided to rotatably connect the outer body 110 and the inner body 120. That is, the inner body 120 may be relatively rotated with the outer body 110 around the connecting shaft 140. Herein, a part of the outer body 110 connected with the inner body 120 by the connecting shaft 140 may be referred to as an outer connecting portion 114, and a part of the inner body 120 connected with the outer body 110 by the connecting shaft 140 may be referred to as an inner connecting portion 122. In addition, the outer connecting portion 114 and the inner connecting portion 122 may be disposed to be close to the pivot axis for the lever motion of the inner body 120 between the one end and the other end of the outer body 110 and the inner body 120.

A valve contact portion 126 may be formed at the one end of the inner body 120. The valve contact portion 126 may be a portion that the inner body 120 is connected with the valve 300. In addition, the roller 130 may be disposed between the valve contact portion 126 and the inner connecting portion 122.

The inner body 120 and the outer body 110 may be selectively locked with each other so as to make a lever motion together, or may be selectively released, or free, to each other so as to make a respective lever motion independently.

The lost motion spring 150 may function to return the outer body 110 being relatively rotated with the inner body 120 by an independent lever motion in a case that the outer body 110 is released from the inner body 120. In addition, the lost motion spring 150 may be disposed to be wound around the connecting shaft 140.

The outer body 110 may include a latching pin groove 119, while a latching pin 160, a latching pin stopper 167 and a latching spring 165 may be disposed at the inner body 120. In addition, the latching pin groove 119, the latching pin 160, the latching pin stopper 167, and the latching spring 165 may be positioned on the other end side of the outer body 110 and the inner body 120 with respect to the connecting shaft 140.

The latching pin groove 119 may be a groove which is formed so that the latching pin 160 is sat, or disposed, thereon. In addition, the latching pin 160 may be operated by hydraulic pressure, and may be disposed at the other end side of the inner body 120 so as to easily receive hydraulic pressure from the hydraulic pressure supply member 400 which may be mounted to the other end side of the inner body 120. Further, the latching pin 160 may be selectively sat, or disposed, on the latching pin groove 119 by supplying hydraulic pressure.

The latching pin stopper 167 may be provided to prevent the latching pin 160 from escaping from the other end of the inner body 120 when the latching pin 160 is protruded toward the other end direction from the inner body 120 by supplied hydraulic pressure so as to be sat, or disposed, on the latching pin groove 119.

The latching spring 165 may be provided to return the latching pin 160 when hydraulic pressure being supplied to the latching pin 160 is released, or changed or lessened. That is, the latching spring 165 may be a spring which is disposed between the latching pin stopper 167 and the latching pin 160 so as to push the latching pin 160 toward the one end direction of the inner body 120. Herein, releasing hydraulic pressure may mean that hydraulic pressure being supplied to the latching pin 160 is smaller than force pushing the latching pin 160 by the latching spring 165.

As the latching pin 160 is sat, or disposed, on the latching pin groove 119 by hydraulic pressure, the inner body 120 may be locked to the outer body 110. In addition, a hydraulic pressure chamber 169, which may be surrounded by the inner body 120 and the latching pin 160, may be formed at one end side of the latching pin 160 in the inner body 120. Further, a hydraulic pressure supply passage 161 may be formed at the inner body 120 so as to communicate the hydraulic pressure chamber 169 with the hydraulic pressure supply member 400.

As the latching pin 160 is pushed toward the other end direction of the inner body 120 by hydraulic pressure supplied from the hydraulic pressure supply member 400 to the hydraulic pressure chamber 169 through the hydraulic pressure supply passage 161, the inner body 120 may be locked to the outer body 110. In addition, as the latching pin 160 is returned by the latching spring 165 in a case that hydraulic pressure supplied to the hydraulic pressure chamber 169 is released, the inner body 120 may be released from the outer body 110. This locking and releasing of the outer body 110 and the inner body 120 may be variously realized depending on design changes by a person of ordinary skill in the art.

A drain hole 163 may be formed at the inner body 120 so as to communicate the hydraulic pressure chamber 169 with an exterior. The drain hole 163 may function to discharge oil forming hydraulic pressure in the hydraulic pressure chamber 169. In addition, the drain hole 163 may be opened to the inside space 122 of the inner body 120. Therefore, oil being discharged to exterior through the drain hole 163 may be supplied as a lubricant for the lost motion spring 150, the connecting shaft 140 and the roller 130 which may be disposed in the inside space 122 of the inner body 120.

Figure 3:
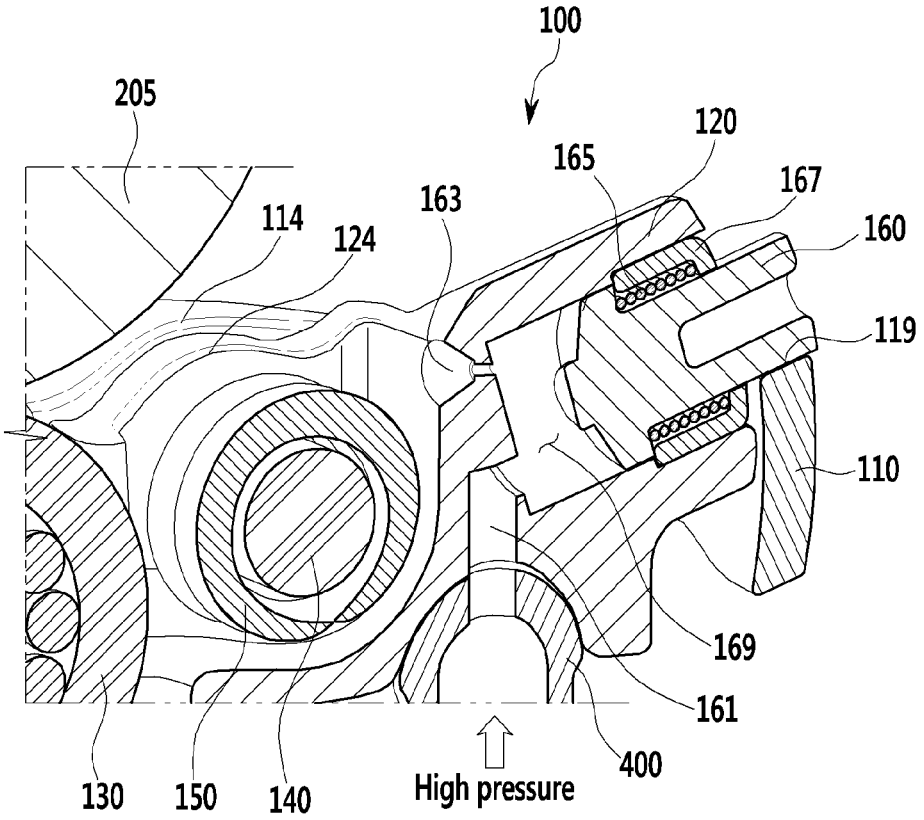
FIG. 3 and FIG. 4 are operation diagrams of a variable valve lift apparatus according to an exemplary embodiment of the present disclosure.
Figure 4:
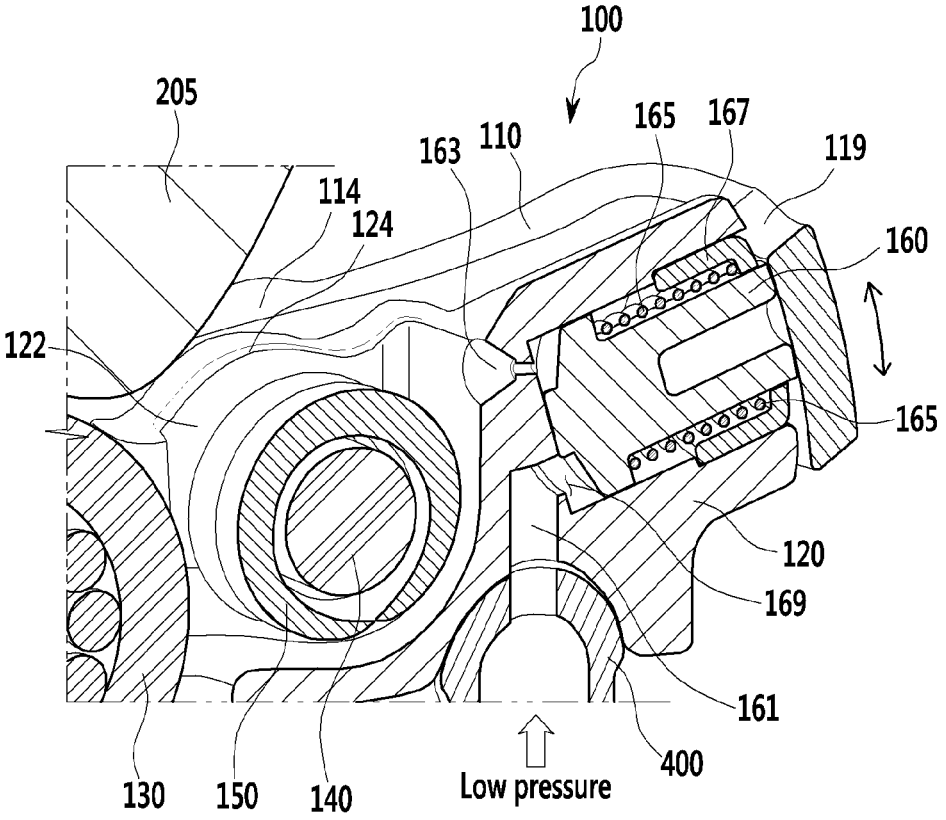

FIG. 3 and FIG. 4 are operation diagrams of a variable valve lift apparatus according to an exemplary embodiment of the present disclosure.

FIG. 3 illustrates an operation on the state of locking the inner body 120 and the outer body 110, and FIG. 4 illustrates a state of releasing the inner body 120 and the outer body 110.

The case of locking the inner body 120 and the outer body 110 may be a case where hydraulic pressure being supplied to the hydraulic pressure chamber 169 is a high pressure which is greater than a force pushing the latching pin 160 by the latching spring 165, and a case of releasing the inner body 120 and the outer body 110 may be a case where hydraulic pressure being supplied to the hydraulic pressure chamber 169 is a lower pressure which is equal to or less than a force pushing the latching pin 160 by the latching spring 165.

Locking of the inner body 120 and the outer body 110 may be performed as the latching pin 160 is sat, or disposed, on and supported within the latching pin groove 119 in the state that the inner body 120 and the outer body 110 are connected with each other by the connecting shaft 140. At this time, the outer body 110 may make a lever motion toward a direction which corresponds to the prevention of the latching pin groove 119 from being separated from the latching pin 160 by an outer stopper 117 formed at the outer body 110 and an inner stopper 127 formed at the inner body 120 (referring to FIG. 2).

The outer stopper 117 may be formed to be protruded into the inside space 112 of the outer body 110, and the inner stopper 127 may be formed to be protruded into the inside space 122 of the inner body 120. In addition, the inner stopper 127 may be disposed at a position corresponding to the outer stopper 117, and the outer stopper 117 and the inner stopper 127 may be disposed a lower end portion of the connecting shaft 140. Further, the outer stopper 117 may be contacted with and supported by the inner stopper 127 in the state that the latching pin 160 is sat, or disposed, on the latching pin groove 119. Therefore, locking to prevent an independent lever motion of the inner body 120 and the outer body 110 may be realized.

If the inner body 120 is locked to the outer body 110, the inner body 120 and the outer body 110 may make a lever motion together around the pivot axis for the lever motion of the inner body 120 by rotation of the high cam 203. At this time, a high lift of the valve 300 is realized by the lever motion of the inner body 120 depending on a rotation of the high cam 203.

If the outer body 110 is released from the inner body 120, the outer body 110 may make a lever motion around the connecting shaft 140 by a rotation of the high cam 203. At this time, the outer body 110 may relatively rotate with the inner body 120, and may not cause a lift of the valve 300. In addition, as the outer body 110 relatively rotates with the inner body 120, the low cam 205 may be rolling-contacted, or rollably contacted, with the roller 130. Therefore, the inner body 120 may make a lever motion around the pivot axis for the lever motion by a rotation of the low cam 205. At this time, a low lift of the valve 300 may be realized by the lever motion of the inner body 120 depending on a rotation of the low cam 205.

Herein, a pad portion 115 facing the camshaft 200 may be formed at the outer body 110, and the high cam 203 may be rolling-contacted with the pad portion 115. Referring to FIG. 1, the pad portion 115 may be formed at both sides in an axial direction of the roller 130. That is, the two high cams 203 may be respectively disposed at both sides of the roller 130 in the axial direction.

Meanwhile, the outer stopper 117 and the inner stopper 127 may function as stoppers which limit a rotation of the outer body 110 from the original position of the outer body 110 when the outer body 110 is relatively rotated with respect to the inner body 120 and returns by the lost motion spring 150. In addition, the original position of the outer body 110 may be the same as a position locking the inner body 120 and the outer body 110.

According to an exemplary embodiment of the present disclosure, the valve lift having two step may be realized. In addition, as constituent elements are disposed to be close to the pivot axis of the inner body 120, a mass center can be close to the pivot axis of the inner body 120. Therefore, a moment of inertia may be reduced, and dynamic characteristics may be stabilized.

While this disclosure has been described in connection with what is presently considered to be practical exemplary embodiments, it is to be understood that the disclosure is not limited to the disclosed embodiments. On the contrary, it is intended to cover various modifications and equivalent arrangements included within the spirit and scope of the appended claims.

What is claimed is:

1. A variable valve lift apparatus comprising:

an outer body for selectively performing a first lever motion depending on a rotation of a high cam, the outer body further forming an inside space;

an inner body disposed in the inside space of the outer body to selectively perform a second lever motion depending on the rotation of the high cam by being selectively locked to the outer body, the selective performing of the second lever motion depending on a rotation of a low cam being released from the outer body, and the inner body being configured so that a valve is connected with one end of the inner body;

a connecting shaft rotatably connecting the outer body with the inner body;

a lost motion spring wound around the connecting shaft to return the outer body after being relatively rotated with respect to the inner body when the outer body is released from the inner body, a latching pin being operated by hydraulic pressure to be selectively protruded from the inner body;

a latching pin groove formed at the outer body so that the latching pin is disposed thereon;

a latching pin stopper preventing the latching pin from escaping from the inner body when the latching pin is protruded from the inner body to be disposed on the latching pin groove by receiving hydraulic pressure; and a latching spring returning the latching pin when hydraulic pressure is supplied to the latching pin, wherein a roller rolling-contacting with the low cam is disposed at the inner body, and the connecting shaft is disposed between a pivot axis for the second lever motion and the roller;

wherein the inner body is locked to the outer body when the latching pin is disposed on the latching pin groove, and wherein a hydraulic pressure chamber which forms hydraulic pressure in an end of the latching pin and a drain hole which discharges oil forming hydraulic pressure in the hydraulic pressure chamber to exterior are formed at the inner body.

2. The apparatus of claim 1, wherein a pad portion being in rolling-contact with the high cam at an outside in an axial direction of the roller, is formed at the outer body.

3. The apparatus of claim 2, wherein the pad portions are disposed at both sides of the roller in the axial direction of the roller, and the high cams are disposed at both sides of the low cam in an axial direction of the low cam.

4. The apparatus of claim 1, wherein a hydraulic pressure supply member, which supplies hydraulic pressure such that the inner body and the outer body are selectively locked, is mounted at another end of the inner body, and the pivot axis for the second lever motion is at a position at which the hydraulic pressure supply member is mounted.

5. The apparatus of claim 1, wherein the latching pin groove, the latching pin, the latching pin stopper and the latching spring are disposed at the other end of the inner body.

6. The apparatus of claim 1, wherein the drain hole is opened such that discharged oil is supplied as a lubricant of the lost motion spring, the connecting shaft and the roller.

7. The apparatus of claim 1, wherein an inner stopper is formed at the inner body and an outer stopper, which is blocked by the inner stopper, is formed at the outer body such that rotation of the outer body is limited to an original position of the outer body when the outer body relatively rotated with respect to the inner body is returned to the original position.

8. The apparatus of claim 7, wherein the outer stopper and the inner stopper are disposed at a lower end portion of the connecting shaft.

9. The apparatus of claim 7, wherein the outer stopper is contacted with and supported by the inner stopper in the state of locking the inner body with the outer body.

* * * * *